United States Patent [19]

Lepistö

[11] Patent Number: 4,932,140

[45] Date of Patent: Jun. 12, 1990

[54] ARRANGEMENT OF PRESSURE NOZZLES FOR THE TREATMENT OF WEBS

[75] Inventor: Matti Lepistö, Turku, Finland

[73] Assignee: Valmet Paper Machinery Inc., Finland

[21] Appl. No.: 358,362

[22] PCT Filed: Sep. 23, 1988

[86] PCT No.: PCT/FI88/00155

§ 371 Date: May 3, 1989

§ 102(e) Date: May 3, 1989

[87] PCT Pub. No.: WO89/02953

PCT Pub. Date: Apr. 6, 1989

[30] Foreign Application Priority Data

Sep. 28, 1987 [FI] Finland ..... 874255

[51] Int. Cl.[5] ..... F26B 13/00

[52] U.S. Cl. ..... 34/156; 34/160; 226/97

[58] Field of Search ..... 34/23, 156, 160; 226/97; 68/5 D

[56] References Cited

U.S. PATENT DOCUMENTS 4,058,244 11/1977 Vits ..... 34/156 X 4,384,666 5/1983 Koponen et al. ..... 34/156 X

*Primary Examiner*—Henry A. Bennet

*Assistant Examiner*—John Sollecito

*Attorney, Agent, or Firm*—Steinberg & Raskin

[57] ABSTRACT

An arrangement of pressure nozzles intended for the treatment of webs comprises a nozzle box. The nozzle box has a carrying face (16) placed facing the web, two nozzle slots (17,18) that blow towards each other being provided in connection with the carrying face, these nozzle slots being placed in the outer part of the space defined by the inner walls (14,15) and the outer walls (20,21) of the nozzle box. The arrangement of nozzles is asymmetric relative to the perpendicular center plane (A—A) of its pressurized carrying face (16). The arrangement of nozzles has a first nozzle slot (18), which is placed relative the carrying face (16) in such a way that the gas jet ($v_1$) blown out of the nozzle slot follows and remains in contact with the curved carrying face (16) up to the area between the nozzle slots (17,18). The arrangement of nozzles includes a second nozzle slot (17), which is placed within the area of the edge of the curved guide face (14,$R_2$) placed in its connection or, in the gas flow direction ($v_2$), before the edge. The ratio of the width of the second nozzle slot (18) to the curve radius ($R_2$) of its guide face (14) is chosen so, with the flow rates ($v_2$) of the second nozzle generally occurring, that the gas flow is separated from the curved ($R_2$) guide face of the second nozzle, before the carrying face area proper between the first and the second nozzle slot (17,18), or in the edge portion of this area.

4 Claims, 1 Drawing Sheet

ARRANGEMENT OF PRESSURE NOZZLES FOR THE TREATMENT OF WEBS

BACKGROUND OF THE INVENTION

The invention concerns an arrangement of pressure nozzles intended for the treatment of webs, comprising a nozzle box, which has a carrying face placed facing a web, two nozzle slots that blow towards each other being provided in connection with the carrying face, the nozzle slots being placed in the outer part of the space defined by the inner walls and the outer walls or equivalent of the nozzle box.

The nozzle arrangement subject of the invention is intended for contact-free supporting and treatment, such as drying, heating or cooling, of paper webs and other continuous webs.

Apparatuses based on the blowing of gas are used commonly in the manufacture and processing of paper. In the apparatuses meant above, the gas to be blown is guided by means of various nozzle arrangements to one side or to both sides of the web, whereupon the treatment gas is sucked off for reuse or for exhaust, and/or the treatment gas is allowed to be discharged to the sides of the web.

The prior-art apparatuses based on contact-free treatment of the web consist of a number of nozzle boxes, out of whose nozzles a gas flow that supports and dries the web is directed at the web. The prior-art nozzles in said apparatuses can be divided into two groups: nozzles with positive pressure and nozzles with negative pressure, where of the operation of the nozzles with positive pressure is based on the air-cushion principle, and the nozzles with negative pressure attract the web and stabilize the run of the web. The attractive force applied to the web is, as is well known, based on a gas flow field parallel to the web, the field forming a static negative pressure between the web and the carrying face of the nozzle.

Both in nozzles with positive pressure and in those with negative pressure, the so-called Coanda effect is commonly used to guide air in the desired direction.

The force applied to the web from prior-art nozzles with negative pressure is relatively low, for which reason these nozzles cannot be used for the treatment of heavy webs or when the tension of the web is low. Thus, nozzles with negative pressure are, as a rule, used in apparatuses whose length does not exceed 5 m and at both sides of which guide rolls are provided to support the web.

The force applied by positive-pressure nozzles to the web is relatively high. Thus, by means of pressure nozzles it is possible to treat heavy and fully untensioned webs. Most of the prior-art pressure nozzles, however, direct sharp jets substantially perpendicularly to the web, thereby producing an uneven distribution of the heat transfer factor in the longitudinal direction of the web, which frequently results in damage to the quality of the web to be treated.

The blowing out of the prior-art pressure nozzles is also unstable, so that the blow jet may turn, e.g. by the effect of the running of the web, directly from the blow opening into the suction space between the nozzles, thereby causing a lowering of the heat transfer factor and an unstable running of the web.

The prior art discussed above comprising, e.g., the U.S. Pat. No. 3,549,070 as well as from the SE Patents Nos. 341,870 and 352,121. These publications suggest nozzles in which, by means of the Coanda effect, attempts have been made to make the blow jets turn and become parallel to the web. Since the outlet directions of the jets form an angle of 90° relative the web, the jets do not have time to turn and to become parallel to the web they are separated from the guide face of the nozzle. In the paper by D. W. McGlaughine and I. Greber, "Experiments on the Separation of a Fluid Jet from a Curved Surface", *The American Society of Mechanical Engineers, Advances in Fluids,* 1976, it has also been established that a jet discharged out of a nozzle can, without being separated, follow along with a curved face 45°. . . 70°, and a following angle of 70° cannot be exceeded. A separated jet collides against the web and causes a peak of the heat transfer factor at the collision point, whereupon the jet seeks its way into the suction space between the nozzles and allows the space between the nozzle slots in the nozzle, the area of the so-called "carrying face" of the nozzle, to remain untreated, which results in substantially no heat transfer in this area.

With respect to of the prior art most closely related to the present invention, reference is made to the applicant's FI Patent No. 68,723 (equivalent of U.S. Pat. No. 4,247,993), wherein a nozzle with negative pressure is described which is mainly characterized in that, in the direction of flow of the gas, the nozzle slot of the nozzle with negative pressure is placed before the plane of the inlet edge of the curved guide face and that the ratio of the width of the nozzle slot to the curve radius of said guide face is, with the gas flow rates occurring in practice, chosen so that the gas flow is separated from the curved guide face substantially before its trailing edge.

The prior art most closely related to the invention is the applicant's FI Patent 60,261 (equivalent of U.S. Pat. No. 4,384,666), wherein a nozzle with positive pressure is described, wherein it is a novel feature that the nozzle slots are located in such a way relative to the carrying face of the nozzle that the gas jets follow along with the carrying face, without being separated, up to the recess formed between the nozzle slots, that the following angle of the gas jets is at the maximum 70°, and that said recess is dimensioned so as to act as a quieting space, wherein the gas jets that flow in opposite directions meet with other and form an air cushion which supports the web and extends over a considerable distance in the direction of running of the web.

OBJECTS AND SUMMARY OF THE INVENTION

The object of the present invention is a further development of the arrangement of pressure nozzles described in the FI Patent 60,261.

A particular object of the invention is to provide such a novel nozzle arrangement of asymmetric construction owing to whose construction and asymmetry it is possible to make the web running over the nozzles behave so that the tendency of wave formation, which results from the transverse unevennesses of contact and weight in the web and from the tension of the web, can be prevented and the web runs in connection with the nozzles calmly without waviness.

In view of achieving the objectives stated above and those that will come out later, the nozzle arrangement in accordance with the invention is mainly characterized in that the construction of the arrangement of nozzles is asymmetric relative to the perpendicular center plane of its pressurized carrying face so that the arrangement of nozzles has a first nozzle slot, which is placed relative the carrying face in such a way that the gas jet blown out of the nozzle slot follows and remains in contact with the curved carrying face (16) up to the area between the nozzle slots and that the arrangement of nozzles includes a second nozzle slot, which is placed within the area of the edge of the curved guide face placed in its connection or, in the gas flow direction, before said edge, the ratio of the width of said second nozzle slot to the curve radius of said guide face being chosen so, with the flow rates of the second nozzle occurring in practice, that the gas flow is separated from the curved guide face of the second nozzle preferably before the carrying-face area proper between the first and the second nozzle slot.

Owing to the asymmetry of the nozzle construction of the invention, the air flows blown out of the nozzle slots towards each other in connection with the carrying face between the nozzle slots can be made to meet each other and to interlock with each other to an ever higher extent without turbulence, which results in an improved conduct of the web in connection with the nozzles and in elimination or at least substantial reduction of formation of transverse wrinkles and waves in the web.

By, in the invention, choosing the magnitudes of the nozzles slots blowing towards each other suitably and by, if necessary, adjusting the velocities of the air jets blown out of them in a suitable ratio to each other, the nozzle arrangement can be "tuned" for optimal operation in all respects, also in view of preventing transverse waviness of the web.

The invention is carried into effect preferably so that the nozzle slot in the nozzle construction at which the gas flow is separated from the curved guide face of a nozzle is placed at the outlet side of the web that is supported, examined in the direction of running of the web. By means of this arrangement, all of the different advantages of the invention are achieved.

In the following, the invention will be described in detail with reference to a preferred exemplifying embodiment of the invention illustrated in the figures in the accompanying drawing, the invention being, however, by no means strictly confined to the details of said embodiment.

DESCRIPTION OF THE PREFERRED EMBODIMENT

Figure 1:
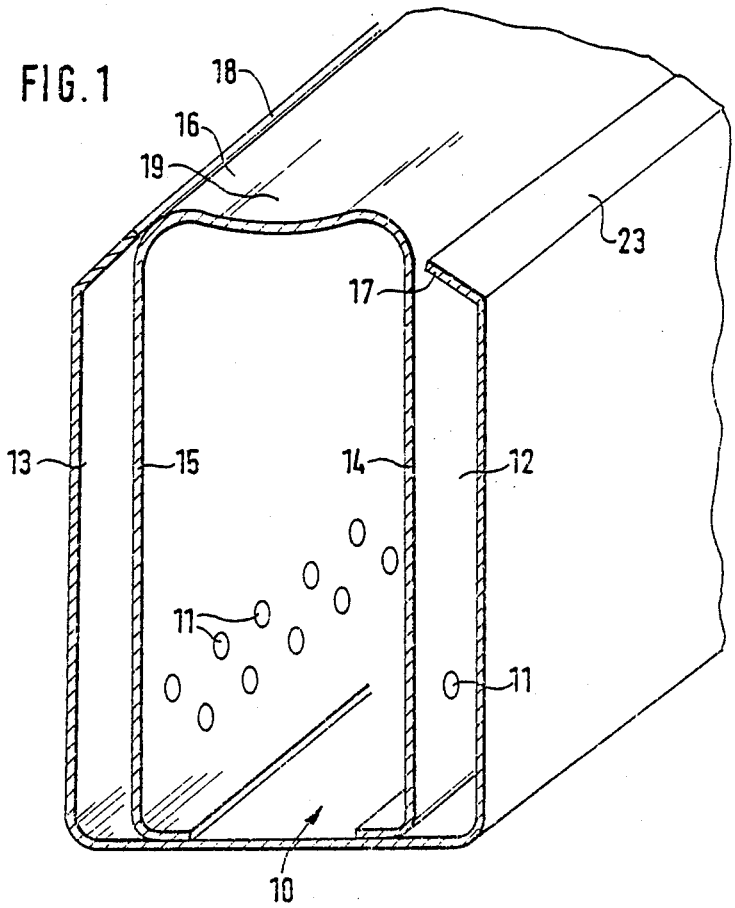
FIG. 1 is an sectional perspective view of an exemplifying embodiment of a nozzle.
Figure 2:
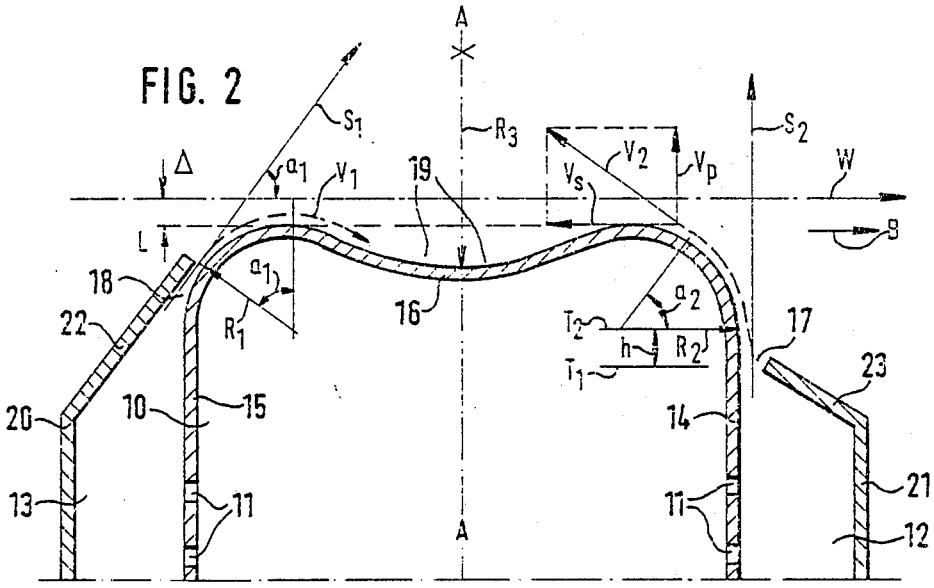
FIG. 2 is a sectional elevational view of the nozzle of FIG. 1 in more detail.

The nozzle arrangement in accordance with FIGS. 1 and 2 comprises a nozzle box, out of whose interior 10 the gas to be blown through the openings 11 is passed into the lateral spaces 12 and 13 of the nozzle, which lateral spaces are confined between the inner walls 14,15 and the outer walls 20 and 21 of the nozzle. The inner walls 14 and 15 are, at their top portions, curved towards each other, e.g., substantially in the form of arcs of a circle (radii $R_1$ and $R_2$) and hereupon, e.g., shaped substantially as an arc of a circle ($R_3$), so that the walls 14, 15 and 16 are symmetric relative the center plane A—A. In this way a carrying face 16 is formed, over which the web W runs in the direction B (at a minimum distance Δ). The plane parts 22,23 of the outer walls 20, 21 of the nozzle box, which are directed towards each other, together with the inner wall 14 and the curved part (radius $R_1$), define the nozzle slots 17 and 18.

The first nozzle slot 18 is placed on the curved $R_1$ part of the walls 15 at the beginning of the angle $a_1$. The angle $a_1$ is the angle between the outlet direction $S_1$ of the gas jet discharged out of the nozzle slot 18 and the plane of the web W that runs facing it as well as, at the same time, the angle of curvature of the guide face of the gas jet starting from the mouth of the nozzle slot 18 up to the tangential plane L—L of the carrying face 16. At the same time, the imaginary plane L—L defines a recess 19 below the plane L—L, which recess 19 acts as a discharge and quieting space, in which the gas jets $v_1$ and $v_2$, which flow in opposite directions, meet each other and form an air cushion which supports the web W and extends over a considerable distance in the direction B of running of the web W. At the recess 19 the curve radius $R_3$ of the carrying face 16 is preferably substantially larger than the curve radii $R_1$ and $R_2$ of the curved parts of the guide faces 15 and 16.

As is shown in FIGS. 1 and 2, the construction of the nozzle arrangement is asymmetric relative its centre plane A—A, because, in the direction B of running of the web W, the latter, i.e. the second nozzle 17,23,14 is placed at a different location as compared with the first nozzle 18,22,15, which is placed as the first one in the direction of running of the web W. The outlet directions $S_2$ of the blowing from the second nozzle slot 17 is substantially perpendicular to the plane of the web W, i.e. the direction $S_2$ of the second nozzle differs from the direction $S_1$ of the first nozzle. According to FIG. 2, the wall 14 of the nozzle chamber continues from the level $T_1$ of the second nozzle slot 17 as planar up to the plane $T_2$, which is at the height h from the former plane $T_1$. From the plane $T_2$ starts the curved wall part, whose curve radius is denoted with $R_2$ and which is preferably identical with the corresponding wall part $R_1$ placed in connection with the first nozzle slot 18. Based on the Coanda effect, the gas flow discharged out of the nozzle slot 17 follows along with the curved guide face within the sector $a_2$, which varies with in the range of 45°. . . 70° in accordance with what what stated above. Thus, at a certain location, the flow is separated from the curved ($R_2$) guide face 14 in a situation in which the flow velocity $v_2$ has a remarkably high velocity component $v_p$ perpendicular to the web W and a velocity component $v_s$ parallel to the plane of the web W, which latter component $v_s$ is preferably of a direction opposite to the direction B of running of the web W. Owing to the invention, the flows $v_1$ and $v_2$ flowing towards each other are interlocked with each other in a stable way so that no turbulence is formed that would wrinkly the web W in the transverse direction and that air can be discharged gently through the recess 19 to the sides of the web W.

The magnitude of the first nozzle slot 18 is preferably within the range of 1.5 . . . 2.5 mm, and that of the second nozzle slot 17, correspondingly, 1.5 . . . 2.0 mm. The air velocities $v_1$ and $v_2$ in the first and second nozzle are preferably within the range of 14 . . . 50 m/s, and velocities can be adjusted to different magnitudes, as compared with the each other ($v_1 \neq v_2$), with a view to optimize the operation of the nozzle arrangement.

In a preferred embodiment of the invention, the curve radii of the curved guide faces of the first and the second nozzle are within the range of $R_1 \approx R_2 = 10 \ldots 35$ mm. The difference in height h between the levels $T_1$ and $T_2$ at the second nozzle 17 is $h = 0 \ldots R\frac{1}{2}$. In a particularly advantageous embodiment of the invention $h \approx o$.

The above angle $a_1$ of the first nozzle slot 18 has been chosen so that separation of the first blowing from the curved face 16 does not take place until the jet ($v_1$) has turned and become fully parallel to the web W. The angle $a_1$ is at the maximum 70° and preferably about 40°. . . 60°. The jets $v_1$ and $v_2$ flowing towards each other within the area of the recess 19 meet each other, and a relatively wide air cushion that supports the web W is formed above the carrying face 16. The heat transfer factor remains good above the recess 19 and also in the area between the nozzle slots 17 and 18.

In FIG. 2, the vertical center plane A—A of the nozzle is shown, which runs at the middle of the bottom of the recess 19 in the carrying face 16. It is essential that the construction of the pressure nozzle is asymmetric relative to its center plane A—A in the way described above and for the purposes mentioned above.

Although preferred embodiments of the invention have been shown herein, numerous other embodiments within the scope of the appended claims will readily occur to those skilled in the art.

What is claimed is:

1. A nozzle box for the treatment of webs such as paper webs comprising:

a base;

a pair of inner walls connected to said base;

a pair of outer walls connected to said base and respectively spaced apart from a first and a second wall of said pair of inner walls;

said nozzle box having a first nozzle means placed between a first curved guide face of a first of said pair of interior walls and a first of said pair of exterior walls and a second nozzle means placed between a second curved guide face of a second of said pair of interior walls and a second of said pair of exterior walls;

a curved carrying face element situated substantially opposite to said base and one of whose ends is joined to said first interior wall at said first guide face and another of whose ends is joined to said second interior wall at said second guide face;

said first nozzle means being oriented such that a first gas jet blown therethrough out of said nozzle box follows and remains in contact with said curved carrying space element while traveling toward said second nozzle means and said second nozzle means being oriented such that a second gas jet blown therethrough out of said nozzle box flows away from said curved carrying space element at an acute angle thereto whereby said first gas jet and said second gas jet meet above said curved carrying space element between said first nozzle means and said second nozzle means to form a gas cushion capable of supporting and treating a continuous web situated above said gas cushion.

2. The nozzle box of claim 1 wherein said curved carrying face element has a recess between said first nozzle means and said second nozzle means.

3. The nozzle box of claim 2 wherein said recess is situated wherein said recess is situated substantially midway between said first nozzle means and said second nozzle means.

4. The nozzle box of claim 1 wherein said first curved guide face and said second guide face are substantially of equal length.

* * * * *